US007237651B2

(12) United States Patent
Avots et al.

(10) Patent No.: US 7,237,651 B2
(45) Date of Patent: Jul. 3, 2007

(54) RAPPELLING APPARATUS

(75) Inventors: Ivars Avots, Arlington, MA (US); Richard Barton, Scituate, MA (US); Herbert H. Loeffler, Arlington, MA (US)

(73) Assignee: EasyDown Corporation, Arlington, MA (US)

( * ) Notice: Subject to any disclaimer, the term of this patent is extended or adjusted under 35 U.S.C. 154(b) by 589 days.

(21) Appl. No.: 10/218,340

(22) Filed: Oct. 4, 2002

(65) Prior Publication Data

US 2004/0065508 A1 Apr. 8, 2004

(51) Int. Cl.
*A62B 1/10* (2006.01)

(52) U.S. Cl. ..... 182/234; 182/239

(58) Field of Classification Search ..... 182/231–240
See application file for complete search history.

(56) References Cited

U.S. PATENT DOCUMENTS 657,641 A * 9/1900 Buddenbohn et al. ..... 182/239
2,990,131 A * 6/1961 Carlsson
4,480,716 A * 11/1984 Soubry et al. ..... 182/239
4,623,038 A * 11/1986 Stancato ..... 182/239

* cited by examiner

*Primary Examiner*—Alvin Chin-Shue
(74) *Attorney, Agent, or Firm*—Karl Hormann

(57) ABSTRACT

A rappelling apparatus providing controlled constant speed to a cable unwinding from a rotating spool in frictional engagement with a stationary arcuate surface. Rotations of the spool are responded to by a centrifugal brake acting in inverse proportion to the rotations. An addition brake is provided for selective actuation by a person using the apparatus.

7 Claims, 8 Drawing Sheets

RAPPELLING APPARATUS

BACKGROUND OF THE INVENTION

1. Field of the Invention

The invention, in general, relates to an apparatus for moving an object from an elevated position to a lower one and, more particularly, to an apparatus for moving an object from an elevated to a lower position at a controlled rate of speed.

2. The Prior Art

Apparatus of the kind here under consideration are well-known and are used, for instance, as emergency escape devices which permit persons in distressful situations to escape from high buildings, mountains and other elevated structures. One such apparatus has been disclosed by U.S. Pat. No. 4,623,038 issued 18 Nov. 1986 to Stancato. It uses two cascading or series-connected centrifugal brake mechanisms the effective braking rate of which must be determined and set manually by a person compelled to act under hazardous or dangerous circumstances when he is least likely to act rationally. Moreover, the brakes are actuated by a relatively complicated gear train of a plurality of gears any one of which may malfunction or jam in circumstances in which reliability is of the utmost importance.

OBJECTS OF THE INVENTION

It is an object of the instant invention to provide for a rappelling apparatus of simple and reliable construction.

A further object is to provide a rappelling apparatus which offers automatic speed control.

Another object of the invention relates to providing a rappelling apparatus the effective braking rate may be preset in proportion to the load to be lowered.

Still another object of the invention is to provide a rappelling apparatus provided with a brake mechanism the action of which is a function of friction between a rappelling cable and a stationary curved surface.

Yet another element is to provide a rappelling apparatus the braking action of which may be modified in accordance with conditions in which it is being used.

It is also an object of the invention to provide a rappelling apparatus equipped with a selectively actuable brake to provide for a complete stop.

Moreover, it is an object of the invention to provide a rappelling apparatus of compact structure by interesting its operating components.

Other objects will in part be obvious and will in part appear hereinafter.

SUMMARY OF THE INVENTION

In the accomplishment of these and other objects the invention, in a currently preferred embodiment thereof, provides for a rappelling apparatus including a spool for receiving a coiled cable and mounted for rotation in response to unwinding the cable, a curved surface of selectively variable length or angle of wrap to subject the cable to predetermined friction thereby to control the speed of the cable unwinding, and a braking mechanism for restricting the speed of the unwinding cable in proportion inversely of the speed.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read with reference to the appended drawings, in which:

and

Figure 6:
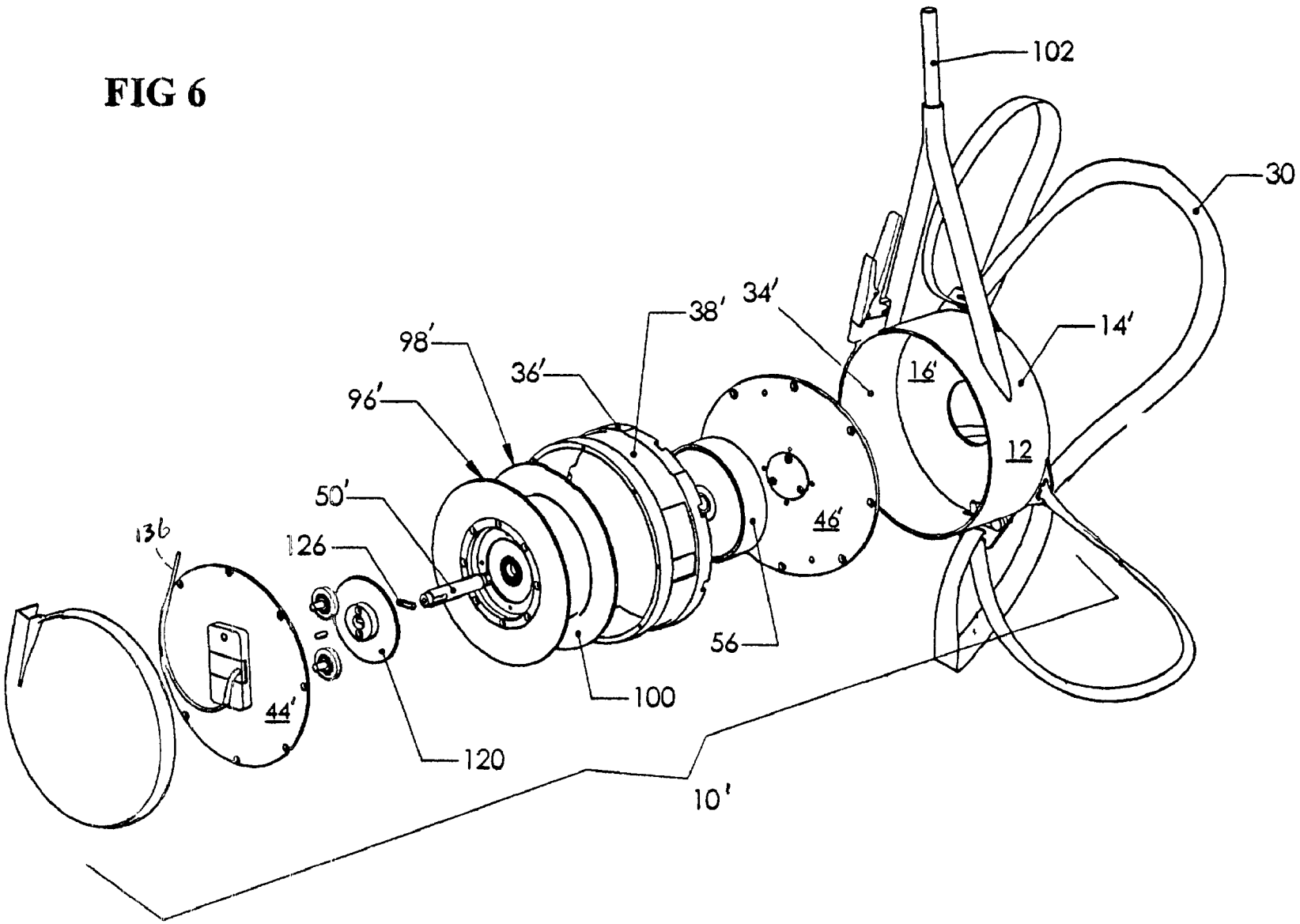
Figure 7:
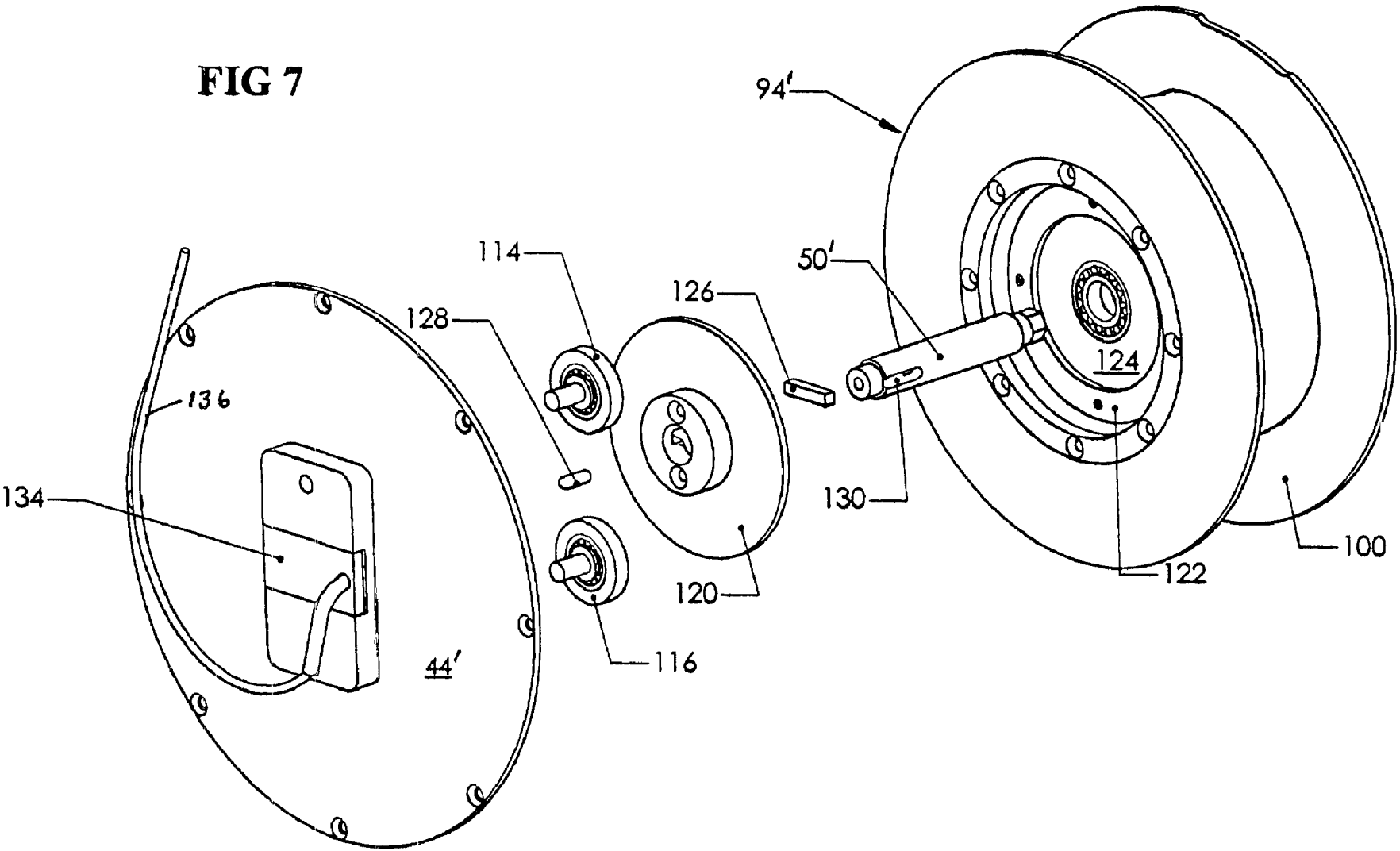
Figure 8:
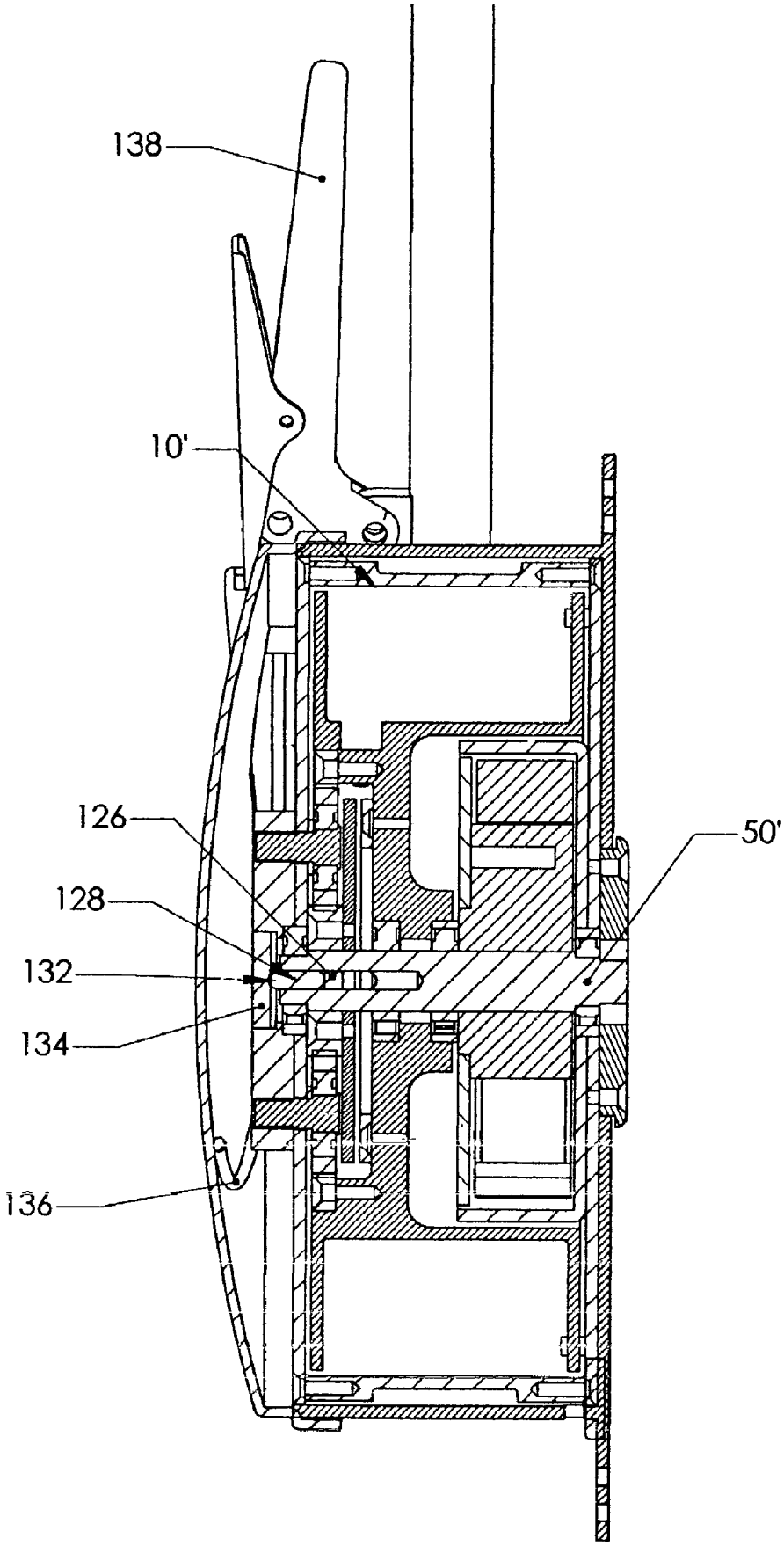
Figure 9:
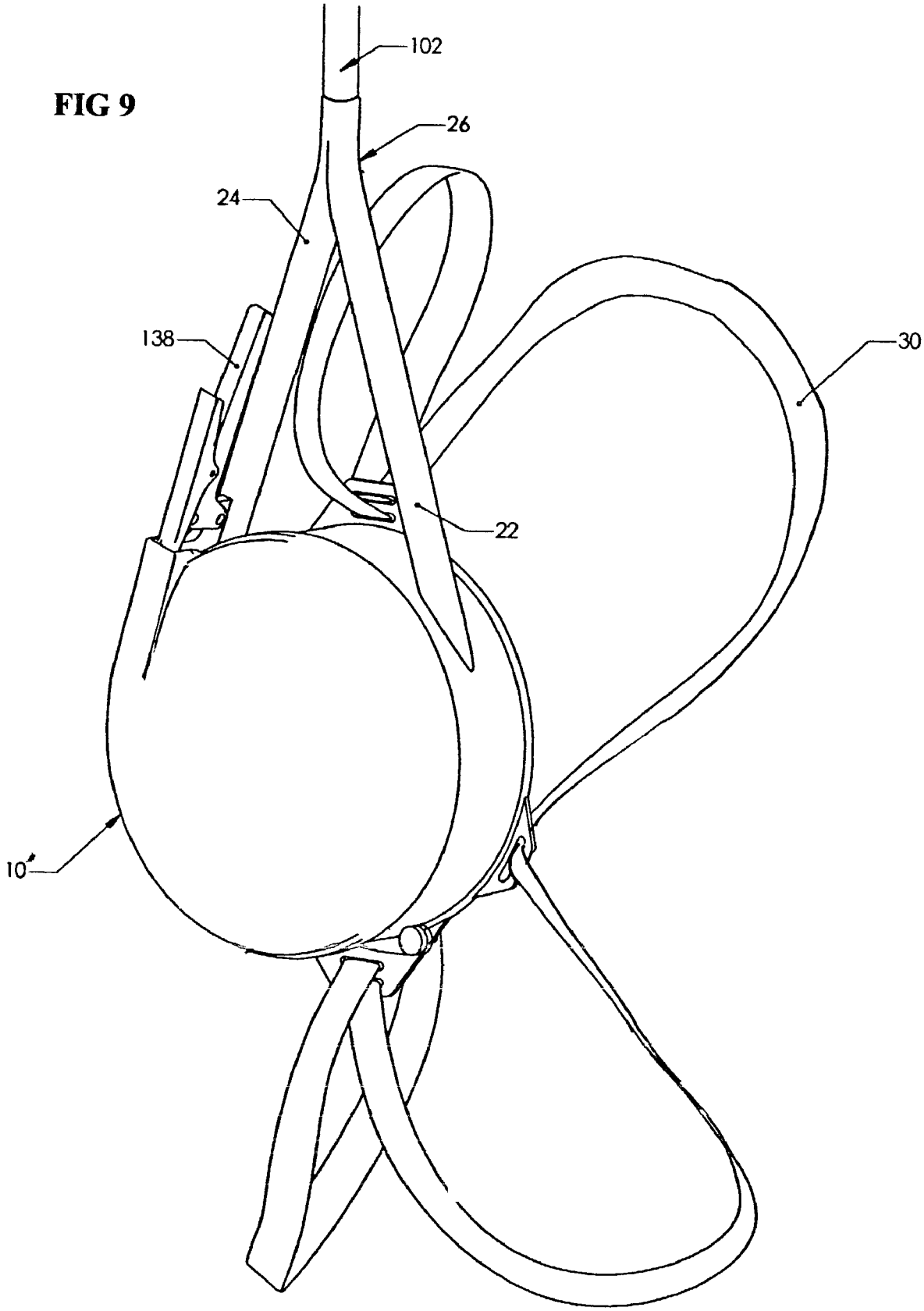

FIG. 6 is an exploded view of an alternative embodiment of the apparatus in accordance with the invention;

FIG. 7 is an exploded view on an enlarged scale showing details of the apparatus of FIG. 6;

FIG. 8 is a cross-section, on an enlarged scale, of the apparatus of FIG. 6 in its assembled state; and FIG. 9 is schematically depicts an apparatus in accordance with the invention strapped to a body harness.

DETAILED DESCRIPTION OF THE PREFERRED EMBODIMENT

Figure 2:
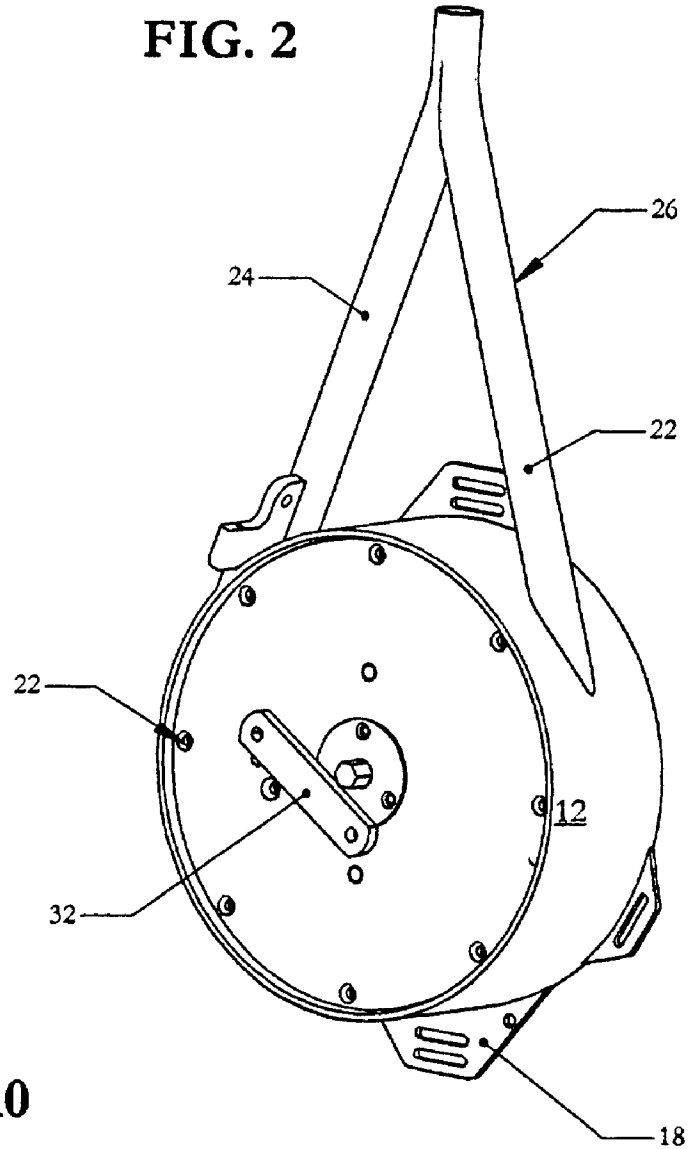
FIG. 2 is a perspective front view of the apparatus of FIG. 1.
Figure 1:
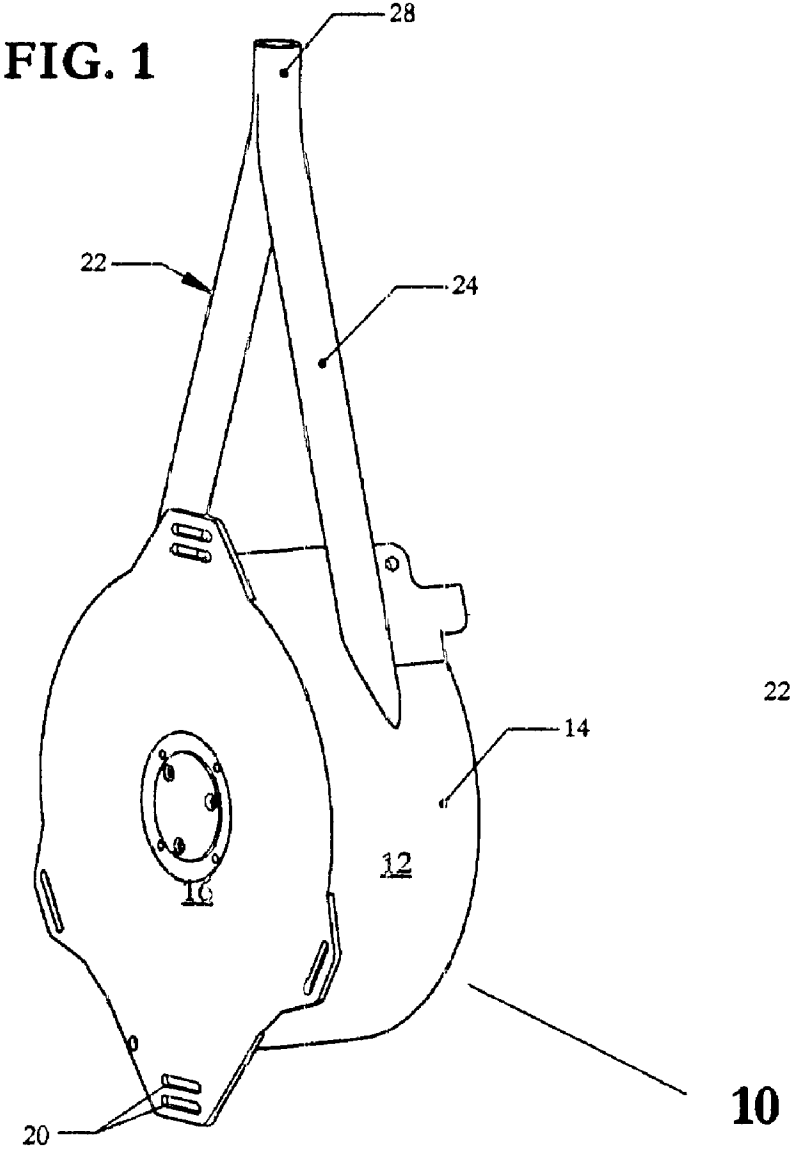
FIG. 1 is a perspective rear view of a first embodiment of a rappelling apparatus in accordance with the invention.
Figure 3:
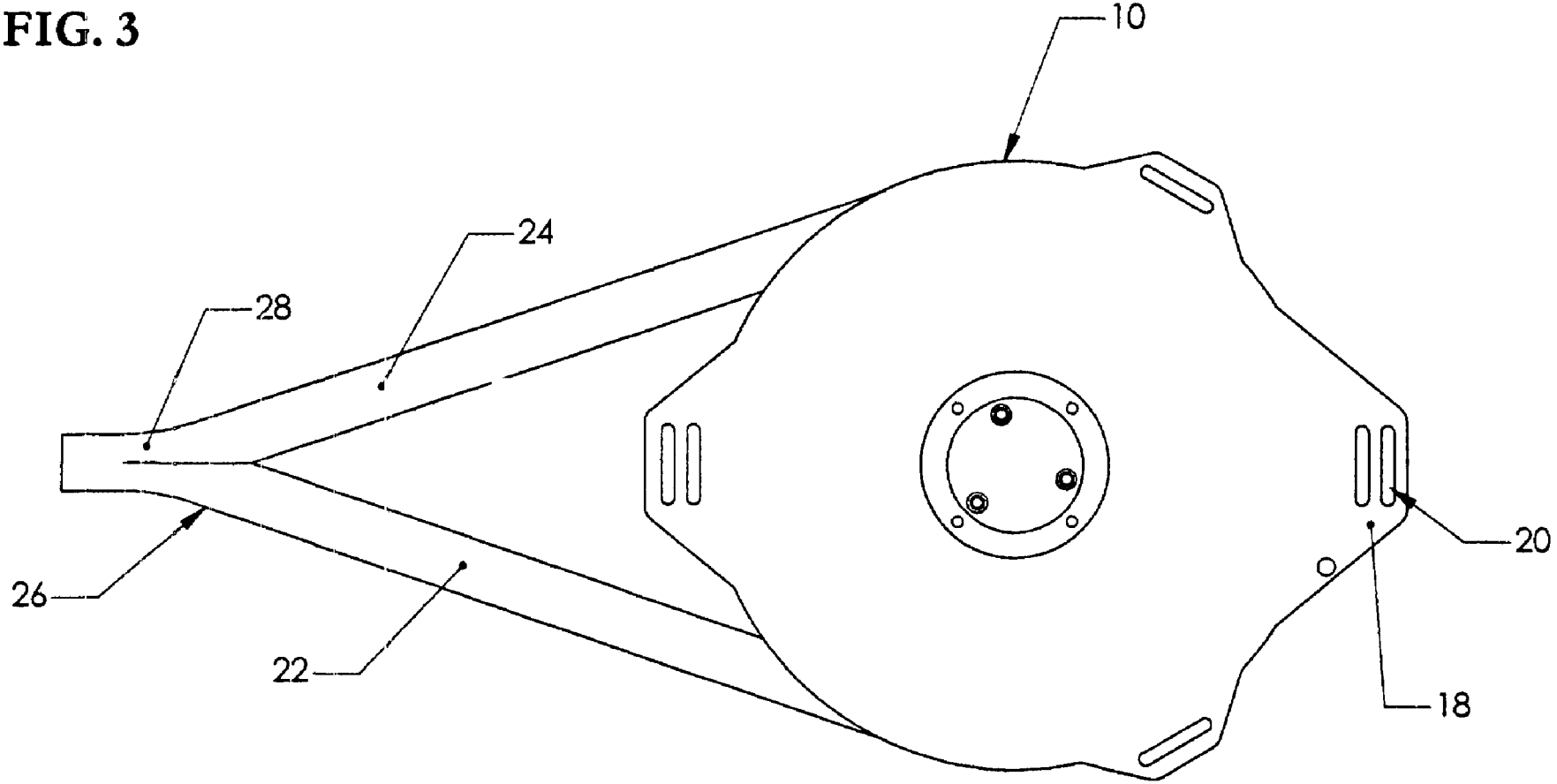
FIG. 3 is a top elevational rear view of the apparatus of FIG. 2 on an enlarged scale.

FIGS. 1 and 2 schematically depict a portable rappelling apparatus 10 in accordance with the invention. The apparatus 10 is of the kind useful for lowering a person from an elevated position such as a high building or mountain in cases of emergency without requiring active intervention by such person to ensure safe operation of the apparatus. For that reason, the apparatus may also be referred to as an emergency escape apparatus.

Figure 5:
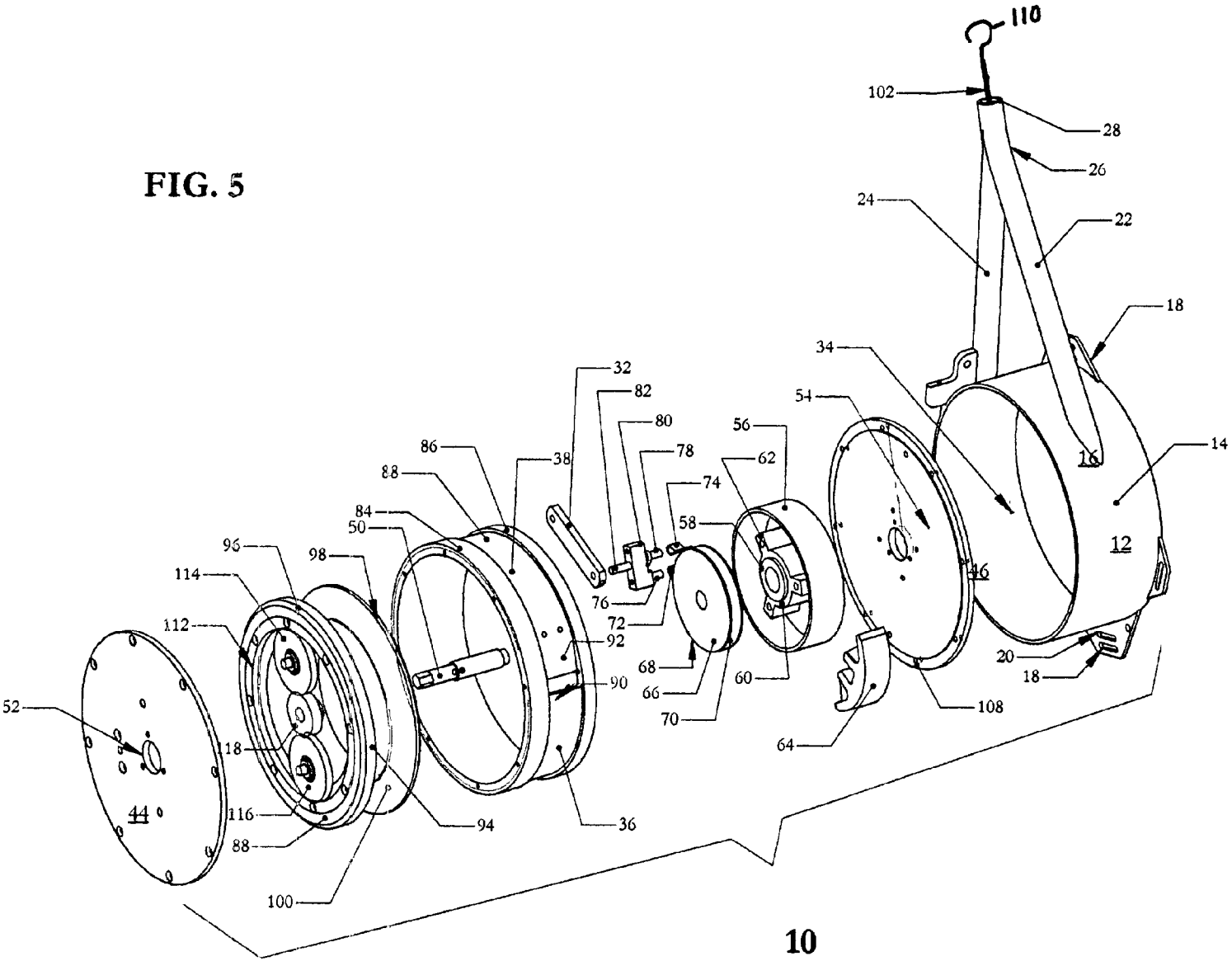
FIG. 5 is an exploded view depicting the components of the apparatus of FIG. 1.

As may be seen more particularly by reference to FIGS. 5 and 6, the apparatus 10 consists of a substantially cylindrical outer housing 12 consisting of a cylindrical wall 14 and a bottom plate 16 provided radial extensions 18. The bottom plate 16 may be integral with the cylindrical wall 14, or it may be affixed thereto by screws or the like as is well known in the art. As shown, the extensions 18 are provided with openings 20 suitably configured for securely attaching the apparatus 10, as, for instance, by threaded bolts, hooks, straps, shackles or the like, either to a structure such as a building or mountain (not shown) from which an escape is to be made or to a harness 30 (FIG. 9) to be connected to a person or article to be lowered from such structure. It will be appreciated that the function of the apparatus does not depend upon whether it is attached to a structure or to a person or article, although, if attached to a person, such person may control the operation of the apparatus in the manner to be described. The components of the housing are made of a strong, preferably heat-resistant light-weight material such, as for instance, aluminum alloy, stainless steel or suitable polymeric material; but those skilled in the art may be assumed to know other materials which are equally well suited for the intended purpose.

Radially extending from the cylindrical wall 14, and affixed thereto, are two converging arms 22, 24 of a Y-shaped yoke 26. For reasons to be described infra, the yoke 26 is of tubular construction and terminates in an open-ended leg 28.

Figure 4:
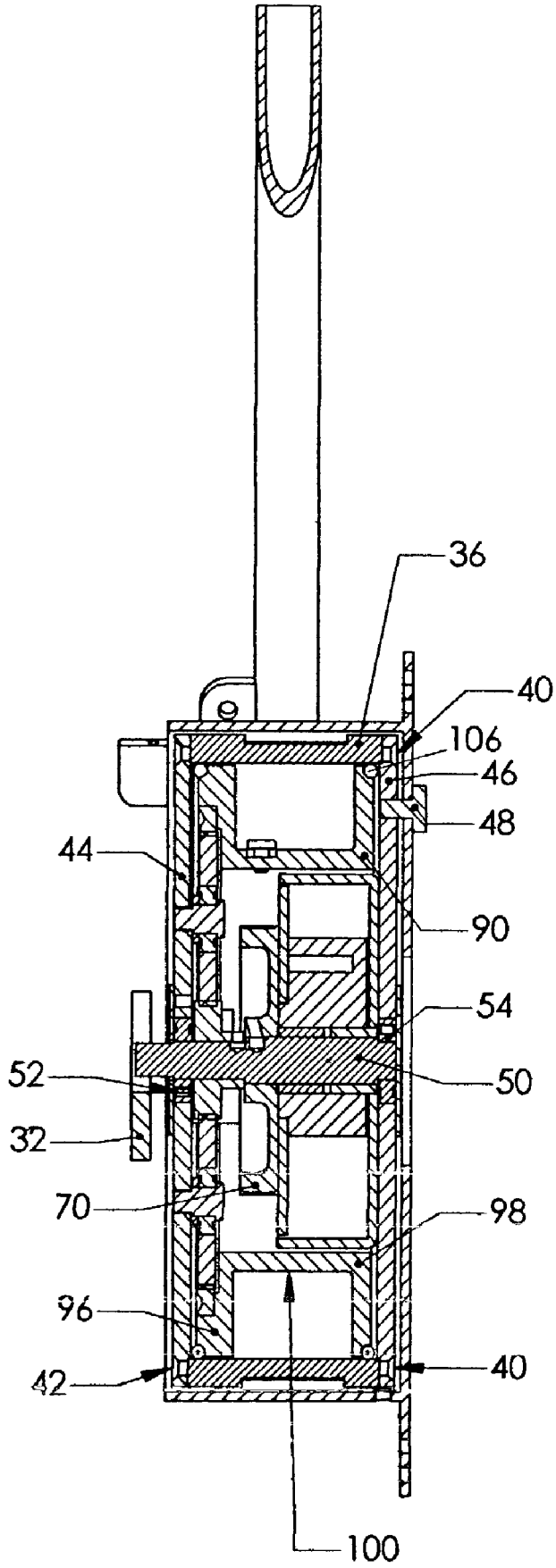
FIG. 4 is a sectional view along line A-A of FIG. 3.

The exterior housing 12 forms a cylindrical chamber 34 for mounting therein an operating assembly of the apparatus. The operating assembly consists of an inner housing 36 constituted by a drum 38, and, affixed thereto by threaded counter-sunk bolts 40, 42, a front plate 44 and a rear plate 46. While the angular disposition of the operating assembly within the chamber 34 relative to the exterior housing 12 is normally fixed by a releasable locking arrangement, such as a spring-loaded pawl or threaded bolt, schematically indicated at 48 (FIG. 4), the assembly may be rotated relative to the exterior housing 12 for purposes to be described. A shaft 50 is journaled in friction-reducing sleeves or bearings 52, 54 coaxially mounted in front plate 44 and rear plate 46, respectively.

A cylindrical brake housing 56 is coaxially mounted on the shaft 50 for rotation relative thereto and is affixed to the rear plate 46. The rear plate 46 is releasably connected to the bottom plate 16 for selectively varying the angular disposition of the inner housing 36 relative to the exterior housing 12. A rotary member 58 consisting of a hub 60 with three radially extending and evenly spaced arms 62 is affixed to the shaft 50 and is located within the brake housing 56. Intermediate the arms 62, brake shoes 64 (only one shown) are movably connected to the hub 60. The brake shoes 64 are centripetally biased towards the hub 60 by springs (not shown) as is well-known in the art. The brake housing 56, the hub 60 and the brake shoes 64 constitute a centrifugal brake of the kind well known in the art which serves to reduce the speed of rotation of the shaft 50 as will be described infra.

A circular brake disc 66 is affixed to the shaft 50 for rotation therewith and is provided with a peripheral surface 68. A band 70 is wrapped around the surface 68 and is provided at its opposite ends with loops 72, 74 for receiving pins 76, 78 extending from an arm 80 in a direction substantially parallel to the shaft 50. The arm 80 may be pivoted by a pin 82 connected to a lever 32 to increase or reduce friction between the peripheral surface 68 of the brake disc 66 and the band 70 for purposes to be described. The pin 82 extends through a bore in the front plate 44, and the lever 32 is mounted for pivotal movement over the outer surface of the front plate 44.

The drum 38 is coaxially disposed around the brake housing 56 as well as the disc 66 and is secured to the rear plate 46. The axial ends of the drum 38 are formed by radial flanges 84, 86 which between them form a substantially cylindrical surface 88. The cylindrical surface 88 has a slotted opening 90 therein which extends across the surface 88 and is bounded at at least one of its sides by a guide surface 92 extending tangentially from the surface 88 into the interior of the drum 38. A spool 94 is rotatably mounted on the shaft 50 inside of the drum 38, over the brake housing 56 and the disc 66. The spool 94 is provided with end flanges 96, 98 and a cylindrical surface 100 for receiving a coiled cable 102 of predetermined length and tensile strength. To reduce friction between the spool 94 and the drum 38 the outer peripheral margin of the flanges 96, 98 may be cut out as exemplarily shown in FIG. 4 to accommodate friction reducing means such as, for instance, ball bearings 104, 106. The length of the cable 102 is, of course, a function of the height of the structure to be serviced by the apparatus of the invention and of the volume provided between the spool 94 and the interior of the drum 38. Unwound from the coil, the length of the cable 102 may, for instance, be at least about 100 meters, and its tensile strength should advantageously be in excess of 1,300 lbs. 1×19 steel cables of 3/32" diameter have been found to be satisfactory. However, those skilled in the art will know of other materials, including polymers of sufficient tensile strength and heat resistance, which may be used in compliance with stated safety standards.

One end of the cable 102 is securely connected to the spool 94. The free end of the cable 102 is fed through the opening 90 over the guide surface 92 and the cylindrical surface 88 of the drum 38 and then through the tubular arm 22 out of the yoke 26. The angle subtended by the length of the cable 102 wrapped over the cylindrical surface 88 of the drum 38 in intimate contact therewith and, hence, the friction generated therebetween, may be adjusted by rotating the drum 38 relative to the external housing 12. To this end, the flange 86 of the inner housing 36 is provided with at least one axial bore or notch (not shown) which may be aligned with any of several equally spaced arresting features, such as, for example, a latch or, as shown in the drawings, bores 108 adjacent to the peripheral margin of the rear plate 46. The position of the drum 38 may be arrested by a threaded bolt (not shown) extending through the axial bore in the flange 86 into the selected one of the bores 108 in the end plate 46. Other arresting devices such as latches or pawls and notches may also be used to secure the angular disposition of the drum 38 within the external housing 12.

In the assembled state of the apparatus 10 the free end of the cable 102 will be provided with appropriate fastening means, such as, for instance, a hook or shackle 110.

An internally toothed annular gear 112 is coaxially connected to the spool 94 in the plane of the flange 96, and forms part of a planetary transmission. The gear 112 meshes with a pair of planetary gears 114, 116 which, in turn, are in meshing engagement with a sun gear 118. The sun gear 118 is affixed to the shaft 50 for transmitting rotary movement of the spool 94 to the rotary member 58 and to the brake disc 66 at a ratio of transmission dependent upon the gear ratios. At present the preferred ratio is such that one revolution of the spool 94 causes the rotary member 58 to rotate three or four times. Other ratios may, of course, be employed.

The front plate 44 closes the cylindrical chamber 34 and is provided with a central bore which may advantageously receive a friction reducing sleeve or ball bearing within which the other end of the shaft 50 is journalled.

Turning now to the alternative embodiment depicted in FIGS. 6, 7 and 8, the reference numerals used for identical components will be the same as those used supra, but primed. The alternative apparatus 10' shown in FIG. 6 and 7 differs from the one of FIG. 5 by the band brake 66, 68 of the latter having been replaced by a disc brake. The disc brake consists of a disc 120 and a brake liner 122 on an axial face 124 of the spool 94'. The disc 120 is affixed by a key 126 on the shaft 50' for rotation therewith and selective axial movement relative thereto. It will be noted that the rotation of the disc 120 is in a direction opposite the direction of rotation of the spool 94', so that engagement between the disc 120 and the brake liner 122 will result in a braking action affecting the spool 94'. Axial movement may be selectively imparted to the disc 120 by a pin 128 seated in an axial recess 130 of the shaft 50'. One end of the pin 128 engages the key 126. The other end of the pin 128 engages a camming surface 132 of a lever 134 pivotally mounted on the front plate 44'. The lever 134 is connected by a Bowden cable 136 or other suitable transmission to a handle 138. Preferably, the lever 134 is biased by a spring (not shown) into a position away from the pin 128 in order to maintain the disc brake in a normal idle state.

Optionally, either or both ends of the shaft 50 may be provided with a key slot for connecting a crank or other mechanism for rewinding the cable 102 as may be particularly desirable if the apparatus 10 is intended for repeated use, for instance, as mountaineering equipment.

The function of the apparatus 10 is as follows: Prior to its first use, the rotational position of the drum 38 or inner housing 36 with respect to the rear plate 46 or external housing 12 will have been set in accordance with the amount of friction to be generated between the cable 102 and the curved guide surface 88. The friction will desirably be related to the weight of the person to whom the apparatus 10 is assigned. Persons of greater weight would mandate a greater angle subtended by the cable 102 on the curved surface 88 of the drum 38 than would persons of lesser weight. Advantageously, the drum 38 will be provided, for instance along its flange 86, with an index scale (not shown) to facilitate its weight-related setting.

A person compelled to evacuate a tall structure will attach the apparatus 10 or the hook 110 either to himself by means of a harness 30 or to a structure. It will hereinafter be assumed that the apparatus 10 is attached to the harness.

The person then climbs out of, or away from, the structure and lowers himself as the cable 102 unwinds from the spool 94 which is thus caused to rotate. As it unwinds, the cable 102 will move through the opening 90, slip over the guide surface 92 and over an arcuate section of the surface 88 of the drum 38. Desirably, the length of the arcuate section or the angle subtended by the cable will have been previously set in the manner described.

As the spool 94 is rotating its movement is transmitted by way of the planetary gear transmission, to the centrifugal brake arrangement housed in the brake housing 56. The rotary member 58 is thus set into rotary motion, and, as a result of centrifugal force thus generated, the brake shoes 64 will be radially moved into engagement with the internal cylindrical surface of the brake housing 56 to generate a braking force in proportion to the speed of rotation of the rotary member 58. The force of the brake shoes 64 acting radially against the brake housing 56 is the square of the speed of rotation of the rotary member 58. This results in a self-balancing brake force and, accordingly, in a controlled constant speed at which the cable 102 is unwinding and the person is descending.

If the person becomes aware of an obstacle in the path of his descent he may move the lever 32 to engage the band brake 68, 70, or he may move the handle 136 to engage the disc brake 120, 122, in order to slow or to stop his descent. Once he has maneuvered himself by the obstacle, he may release the brake and continue his descent.

What is claimed is:

1. A rappelling apparatus, comprising:

a external housing for forming a substantially cylindrical chamber having a radially directed opening;

an internal housing seated in the outer housing and comprising front and rear walls forming coaxially disposed first and second journal openings and connected to each other by a substantially cylindrical wall having an aperture therein;

a shaft mounted for rotation in the journal openings;

a spool coaxially mounted on the shaft for rotation relative thereto within the internal housing;

a cable wound on the spool and having a leader extending through the opening and the aperture in engagement with the cylindrical wall for over an arcuate portion thereof for generating friction between the cable and the arcuate portion surface for retarding rotations of the spool as a function movement of the cable through the opening upon application of a load to the leader.

2. The apparatus of claim 1, wherein the internal housing is mounted for selective rotation relative to the cylindrical chamber for varying the length of the arcuate portion.

3. The apparatus of claim 2, further comprising:

an internally toothed gear coaxially connected to the spool;

a toothed gear affixed to the shaft;

at least one toothed gear for connecting the internally toothed gear to the gear on the shaft;

a centrifugal brake comprising a brake housing disposed coaxially of the shaft and affixed to the external housing; and means mounted on the shaft for engaging the brake housing in response to rotation of the shaft.

4. The apparatus of claim 3, wherein the means for engaging the brake housing comprises at least one brake shoe resiliently connected to the shaft.

5. The apparatus of claim 3, further comprising:

a brake disk affixed to the shaft for rotation therewith;

means for selectively applying a braking force to the disc.

6. The apparatus of claim 5, wherein the means for selectively applying a braking force to the disc comprises a band of selectively variable length wrapped around a peripheral surface of the brake disk.

7. The apparatus of claim 5, further comprising:

a layer of friction material on an axial surface of the spool; and a brake disc rotatably keyed to the shaft for selective axial movement relative to the layer of friction material.

* * * * *